US007376982B1

(12) United States Patent
Pencheon

(10) Patent No.: US 7,376,982 B1
(45) Date of Patent: May 27, 2008

(54) TOILET BOWL VENTING APPARATUS

(76) Inventor: Vance Pencheon, Christ Church, St. Kitts (KN)

( * ) Notice: Subject to any disclaimer, the term of this patent is extended or adjusted under 35 U.S.C. 154(b) by 199 days.

(21) Appl. No.: 11/201,691

(22) Filed: Aug. 11, 2005

(51) Int. Cl.
*E03D 9/04* (2006.01)

(52) U.S. Cl. ..... 4/213; 4/352

(58) Field of Classification Search ..... 4/213, 4/217, 352
See application file for complete search history.

(56) References Cited

U.S. PATENT DOCUMENTS

| | | | | |
|---|---|---|---|---|
| 5,345,617 | A * | 9/1994 | Jahner et al. | 4/217 |
| 5,454,122 | A * | 10/1995 | Bergeron | 4/217 |
| 7,117,548 | B1 * | 10/2006 | Reyes | 4/213 |
| 2002/0069455 | A1 * | 6/2002 | Pottinger | 4/213 |
| 2003/0019019 | A1 * | 1/2003 | Blanch et al. | 4/213 |

* cited by examiner

*Primary Examiner*—Charles E. Phillips
(74) *Attorney, Agent, or Firm*—Michael I Kroll

(57) ABSTRACT

Apparatus 10 discloses a venting apparatus for a toilet bowl 12 using a gasket 18 that is positioned between a toilet seat 14 and toilet bowl rim 16 forming a gasket-like seal therebetween. The toilet bowl gasket 18 is comprised of a pliable oval-like housing having an interior cavity 20 therein. Located remotely to the venting apparatus is a motorized exhaust fan 22 connected to conduit 24 extending between the toilet seat venting apparatus and discharge vent 26. The exterior walls have a plurality of apertures 28, 30 therein serving to draw air from the toilet bowl 12 and exterior ambient air through the cavity 20 to an aperture having an exteriorly extending nipple 32 with the aforementioned conduit attached thereto whereby activating the pump 22 causes air to be drawn into the cavity 20 and discharged at the point of discharge 26. The exterior ambient air apertures 28 and the toilet bowl interior apertures 30 vary in diameter whereby a larger interior aperture results in a low pressure gradient 38 existing within the bowl interior and a high pressure gradient 40 on the exterior side thereby insuring that the majority of air is drawn from the toilet bowl. A shield 42 is formed over each of the apertures 28, 30 to prevent errant urination from passing into the cavity 20.

11 Claims, 11 Drawing Sheets

TOILET BOWL VENTING APPARATUS

BACKGROUND OF THE INVENTION

1. Field of the Invention

The present invention relates generally to toilets and, more specifically, to a venting apparatus for a toilet bowl that is positioned between a toilet seat and toilet bowl rim forming a gasket-like seal therebetween. The toilet bowl gasket is comprised of a pliable oval-like housing having a top wall, bottom wall with opposing exterior walls forming an interior cavity. Located remotely to the venting apparatus is a pump connected to conduit extending between the toilet seat venting apparatus and discharge vent. The exterior walls have a plurality of apertures serving to draw air from the toilet bowl and exterior ambient air through the cavity to an aperture having an exteriorly extending nipple with the aforementioned conduit attached thereto whereby engaging the pump causes air to be drawn into the cavity and discharged at the conduit point of discharge.

The present invention provides additional elements in the form of varying the aperture diameters of the exterior ambient air apertures and the toilet bowl interior apertures whereby a larger interior apertures results in a low pressure area existing within the bowl interior and a high pressure area on the exterior side thereby insuring that the majority of air is drawn from the toilet bowl.

Additionally the present invention provides a hood-like element formed over each of the apertures to prevent errant urination from passing into the venting aperture cavity, which will allow a longer operative cycle before the oval-like housing is disconnected from the egress conduit and washed.

It is further provided that a venting cycle may incorporate an egress and ingress function including a one-valve past the motor egress side so that reversing air flow can employee odoriferous material having a desired scent exhausted into the venting apparatus and ultimately the ambient air.

2. Description of the Prior Art

There are other devices designed for venting, while these devices may be suitable for the purposes for which they were designed, they would not be as suitable for the purposes of the present invention, as hereinafter described.

Therefore, it is felt that a need exists for a simple mechanism that can be retrofitted to existing toilets that will provide for the venting of malodorous odors from a toilet bowl to a remote discharge point.

Furthermore, it is felt that said need is best served through employment of a pliable gasket-like devices placed over the toilet bowl rim substantially conforming to the shape of said rim that will engage the bottom surface of the toilet seat amply forming a seal that when used in conjunction with a motor will draw air from the toilet bowl to a designated discharge point.

SUMMARY OF THE PRESENT INVENTION

The present invention discloses a venting apparatus for a toilet bowl using a gasket that is positioned between a toilet seat and toilet bowl rim forming a gasket-like seal therebetween. The toilet bowl gasket is comprised of a pliable oval-like housing having a top wall, bottom wall with opposing exterior walls forming an interior cavity therein. Located remotely to the venting apparatus is a motorized air pump or fan connected to conduit extending between the toilet seat venting apparatus and discharge vent. The exterior walls have a plurality of apertures serving to draw air from the toilet bowl and exterior ambient air through the cavity to an aperture having an exteriorly extending nipple with the aforementioned conduit attached thereto whereby engaging the pump causes air to be drawn into the cavity and discharged at the conduit point of discharge. Additional elements in the form of varying the aperture diameters of the exterior ambient air apertures and the toilet bowl interior apertures whereby a larger interior aperture results in a low pressure area existing within the bowl interior and a high pressure area on the exterior side thereby insuring that the majority of air is drawn from the toilet bowl. A hood-like element is formed over each of the apertures to prevent errant urination from passing into the venting aperture cavity, which will allow a longer operative cycle before the oval-like housing is disconnected from the egress conduit and washed.

A primary object of the present invention is to provide means for venting malodorous odor from a toilet bowl to a predetermined discharge point.

Another object of the present invention is to provide a toilet bowl venting apparatus incorporating a pliable oval-like gasket in communication with a pump in communication with a predetermined discharge point.

Yet another object of the present invention is to provide a toilet bowl venting apparatus wherein said oval like gasket has a top wall, bottom wall and opposing exterior walls forming housing for a cavity passing therethrough.

Still yet another object of the present invention is to provide a toilet bowl venting apparatus wherein said oval like gasket has a plurality of aperture in the opposing side walls providing for the passage of air into said cavity.

Another object of the present invention is to provide a toilet bowl venting apparatus wherein said oval like gasket housing has a cavity egress aperture with a nipple exteriorly extending for the attachment of conduit.

Yet another object of the present invention is to provide a toilet bowl venting apparatus wherein said oval like gasket's plurality of apertures can vary diametrically to create high and low pressure gradients on opposing sides of said oval-like gasket.

Still yet another object of the present invention is to provide a toilet bowl venting apparatus wherein said plurality of apertures can be formed with hood-like protrusion forming an integral part therewith to limit the possibility of urine passing into the gasket during errant urination.

Another object of the present invention is to provide a toilet seat venting apparatus wherein said gasket-like member can be easily disconnected from the venting conduit for cleaning purposes.

Yet another object of the present invention is to provide a toilet seat venting apparatus wherein said gasket-like member can be easily disconnected from the venting conduit for cleaning purposes.

Still yet another object of the present invention is to provide a toilet seat venting apparatus having length of conduit leading from the gasket-like member to a predetermined discharge point.

Another object of the present invention is to provide a toilet seat venting apparatus having a pump positioned between said gasket-like egress aperture and said vent discharge point.

Yet another object of the present invention is to provide a toilet seat venting apparatus wherein said pump can be selectively started and stopped.

Still yet another object of the present invention is to provide a toilet seat venting apparatus that when said pump is engaged air is drawn through the plurality of gasket apertures into the gasket cavity and exhausted to a remote location through use of length of conduit and pump connected to the oval-like gasket egress nipple.

Additional objects of the present invention will appear as the description proceeds.

The present invention overcomes the shortcomings of the prior art by providing The present invention relates generally to toilets and, more specifically, to a venting apparatus for a toilet bowl that is positioned between a toilet seat and toilet bowl rim forming a gasket-like seal therebetween. The toilet bowl gasket is comprised of a pliable oval-like housing having a top wall, bottom wall with opposing exterior walls forming an interior cavity. Located remotely to the venting apparatus is a pump connected to conduit extending between the toilet seat venting apparatus and discharge vent. The exterior walls have a plurality of apertures serving to draw air from the toilet bowl and exterior ambient air through the cavity to an aperture having an exteriorly extending nipple with the aforementioned conduit attached thereto whereby engaging the pump causes air to be drawn into the cavity and discharged at the conduit point of discharge.

The present invention provides additional elements in the form of varying the aperture diameters of the exterior ambient air apertures and the toilet bowl interior apertures whereby a larger interior apertures results in a low pressure area existing within the bowl interior and a high pressure area on the exterior side thereby insuring that the majority of air is drawn from the toilet bowl.

Additionally the present invention provides a hood-like element formed over each of the apertures to prevent errant urination from passing into the venting aperture cavity, which will allow a longer operative cycle before the oval-like housing is disconnected from the egress conduit and washed.

It is further provided that a venting cycle may incorporate an egress and ingress function including a one-valve past the motor egress side so that reversing air flow can employee odoriferous material having a desired scent exhausted into the venting apparatus and ultimately the ambient air.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
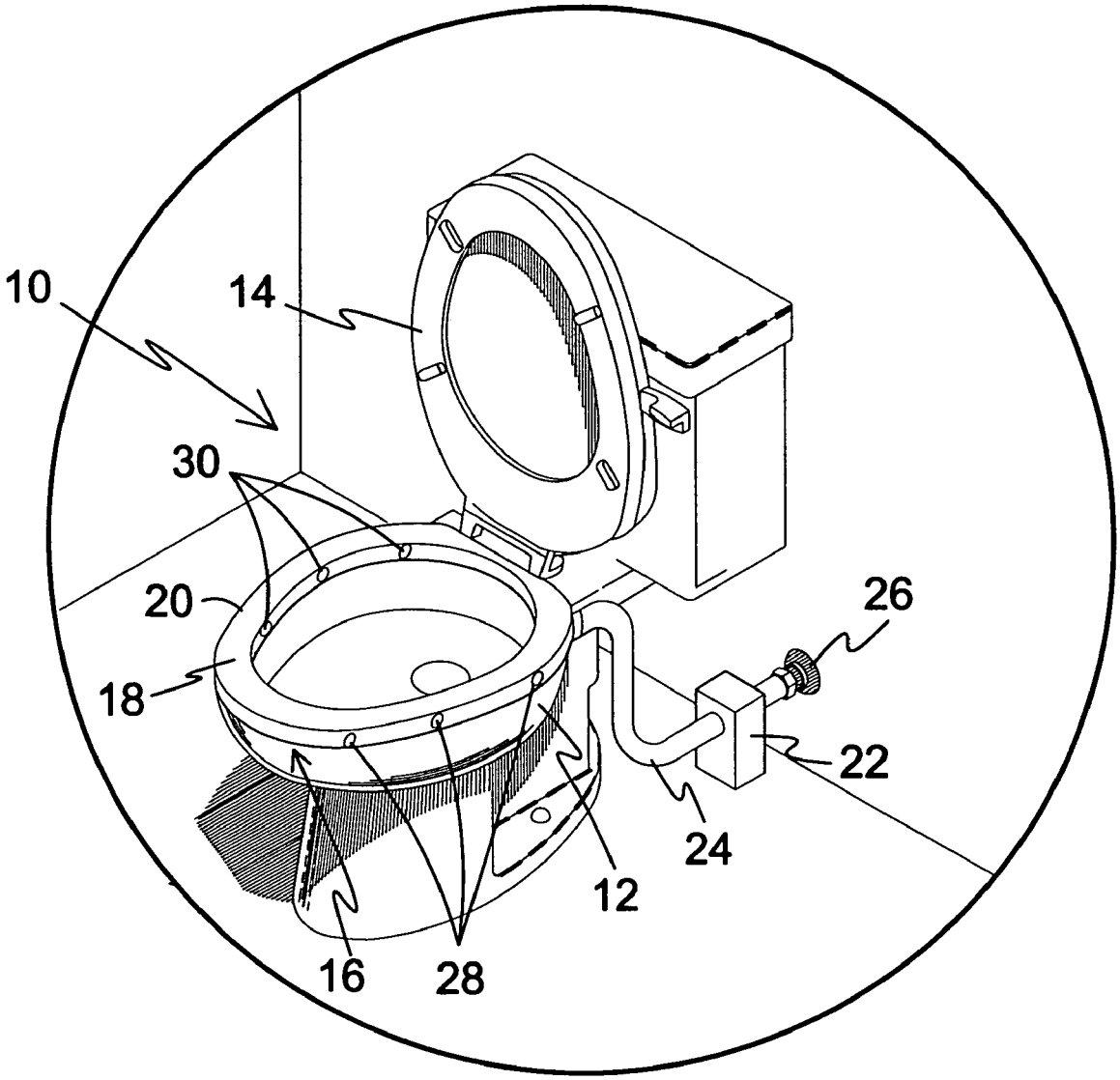
FIG. 1 is an illustrative view of the present invention installed.

With regard to reference numerals used, the following numbering is used throughout the drawings.

10 present invention
12 toilet bowl
14 toilet seat
16 rim of bowl
18 seal/gasket
20 cavity
22 discharge fan
24 conduit/hose
26 discharge vent
28 fresh air apertures
30 foul air apertures
32 connection for conduit/egress aperture
34 fresh air
36 foul air
38 low pressure gradient
40 high pressure gradient
42 hood/shield
44 ridge

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 installed. The present invention 10 is a venting apparatus for a toilet bowl 12 that is positioned between a toilet seat 14 and toilet bowl rim 16 forming a gasket-like seal 18 therebetween. The toilet bowl gasket 18 is comprised of a pliable oval-like housing having a top wall, bottom wall with opposing exterior walls forming an interior cavity 20. Located remotely to the venting apparatus is a motorized air pump or discharge/exhaust fan 22 connected to conduit 24 extending between the toilet seat venting apparatus 10 and discharge vent 26 to the exterior of the room housing the toilet/commode. The exterior walls have a plurality of fresh air apertures 28 serving to draw air from the toilet bowl and exterior ambient air through the cavity 20 to a foul air aperture 30 having an exteriorly extending nipple with the aforementioned conduit 24 attached thereto whereby engaging the pump 22 causes air to be drawn into the cavity 20 and discharged at the conduit point of discharge 26.

Figure 2:
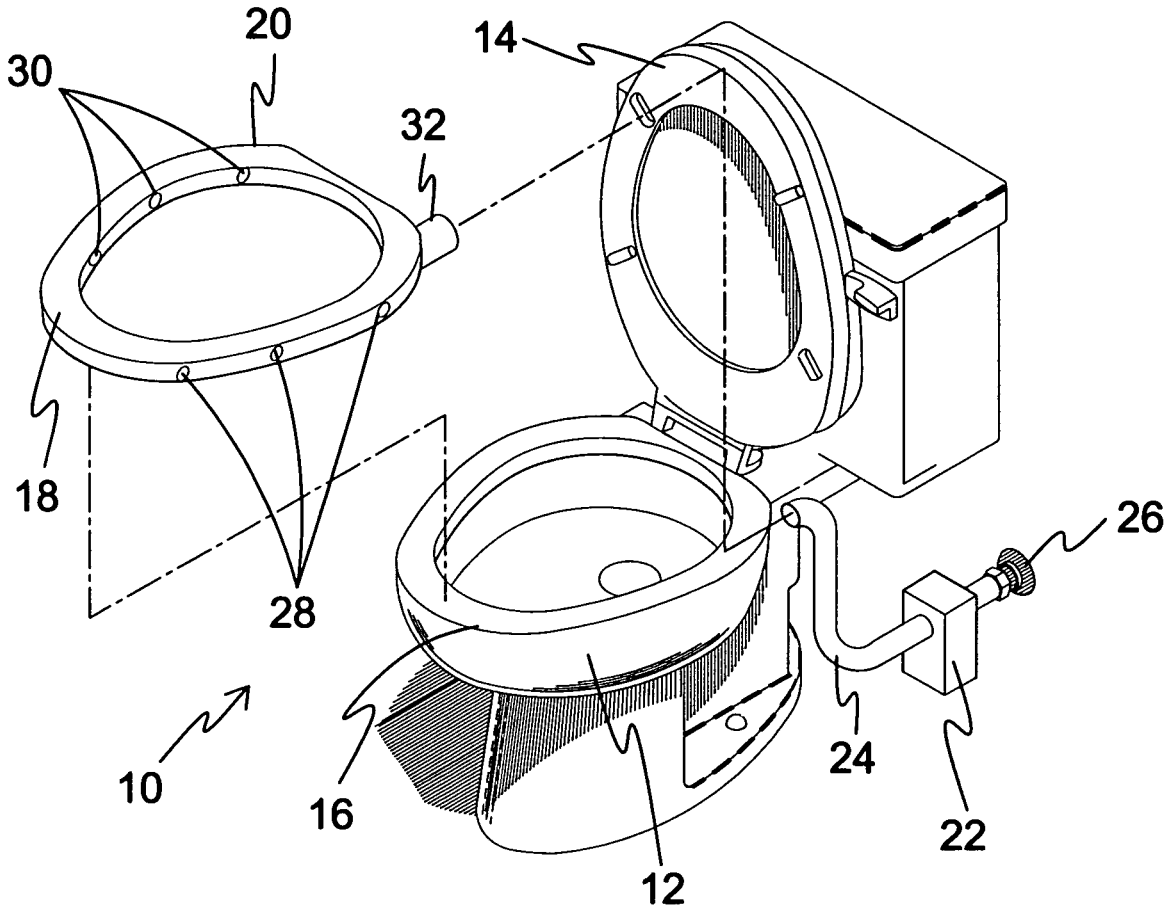
FIG. 2 is an exploded view of the present invention.

Turning to FIG. 2, shown therein is an exploded view of the present invention 10. Shown is the present invention 10 forming a fresh air and foul smelling air circulation and extraction device shaped to fit like a gasket 18 between a toilet seat 14 and the top rim portion 16 of the toilet bowl 12. A plurality of small fresh air vents 28 are located at various intervals that allow fresh air from the room to enter into the inner chamber/cavity 20 of the device 18 and at the same time, allowing foul air from the toilet bowl to enter into the chamber using vents 30. The air (fresh and foul) is then sucked from the chamber 20 via a hose 24 by means of a motorized exhaust fan 22, which is attached to the hose, sucking the air out through an external vent 26. Also shown is hose connection/egress conduit 32.

Figure 3:
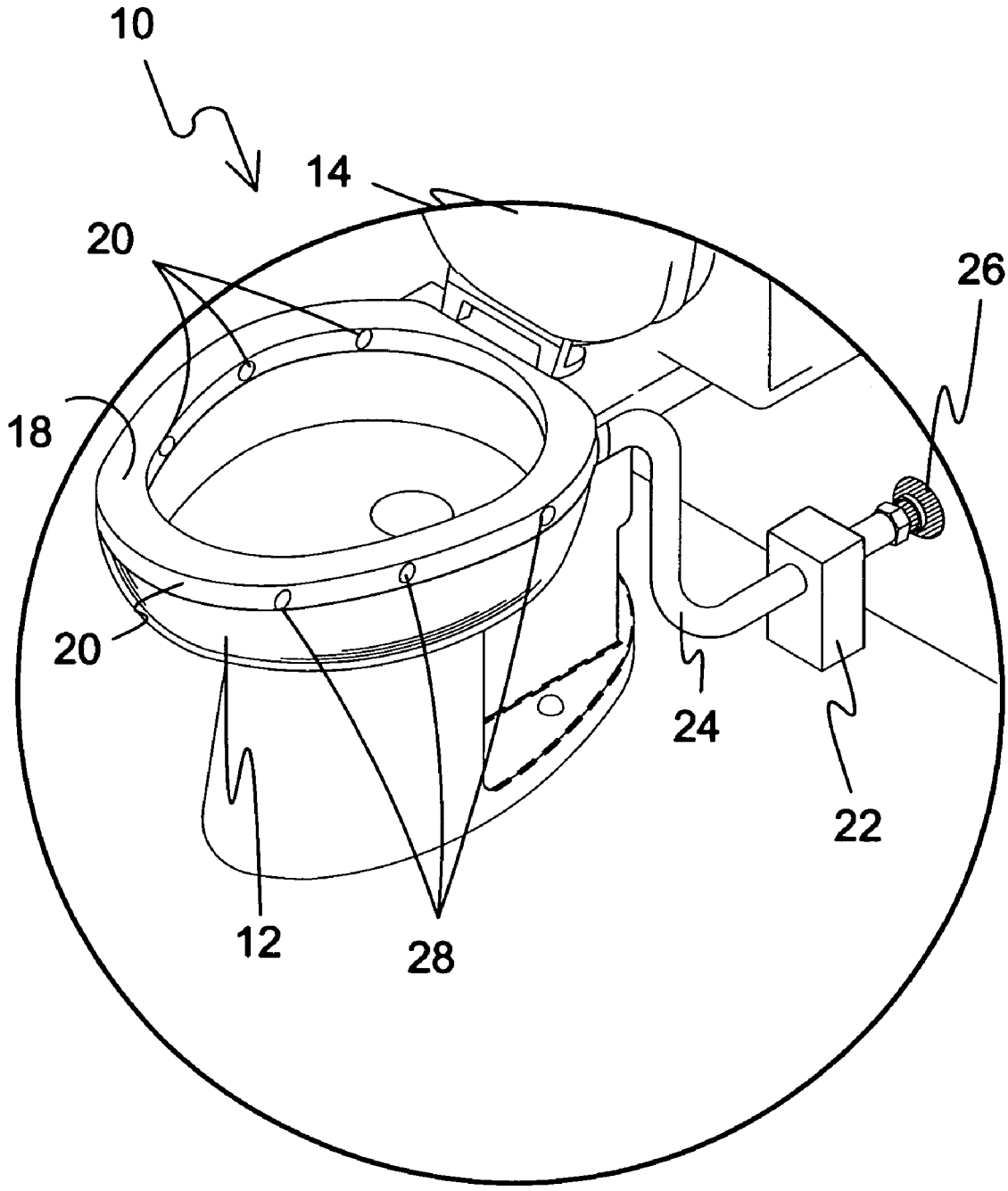
FIG. 3 is a detailed view of the present invention.

Turning to FIG. 3, shown therein is a detailed view of the present invention 10. Shown is a detailed view of the present invention 10 disclosing a fresh air and foul smelling air circulation and extraction device shaped to fit like a gasket 18 between a toilet seat 14 and the top portion of the toilet bowl 12. A plurality of small vents 28 are located at various intervals and allow fresh air from the room to enter into the inner chamber 20 of the device and at the same time, allowing foul air from the toilet bowl to enter into the chamber using vents 30. The air (fresh and foul) is then sucked from the chamber 20 via a hose 24 by means of a discharge motor 22, which is attached to the hose, sucking the air out through an external vent 26.

Figure 4:
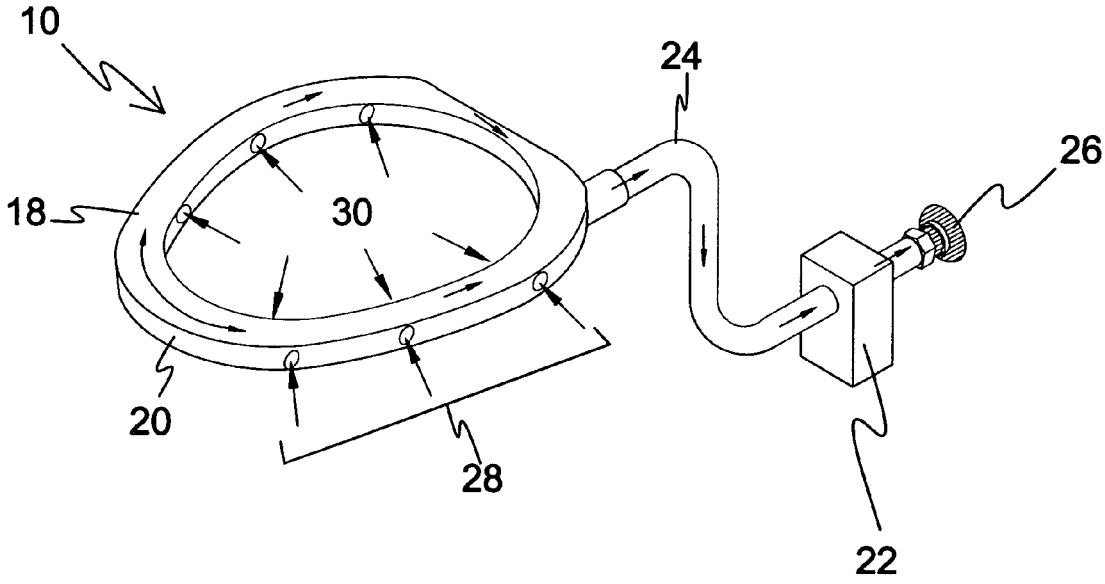
FIG. 4 is a perspective view of the present invention.

Turning to FIG. 4, shown therein is a perspective view of the present invention 10. Shown is a perspective view of the present invention 10 disclosing a fresh air and foul smelling air circulation and extraction device shaped to fit like a gasket 18 between a toilet seat and the top portion of the toilet. A plurality of small vents 28 are located at various intervals and allow fresh air from the room to enter into the inner chamber 20 of the device and at the same time, allowing foul air from the toilet bowl to enter into the chamber through vents 30. The air (fresh and foul) is then sucked from the chamber 20 via a hose 24 by means of a motorized fan 22, which is attached to the hose, sucking the air out through an external vent 26.

Figure 5:
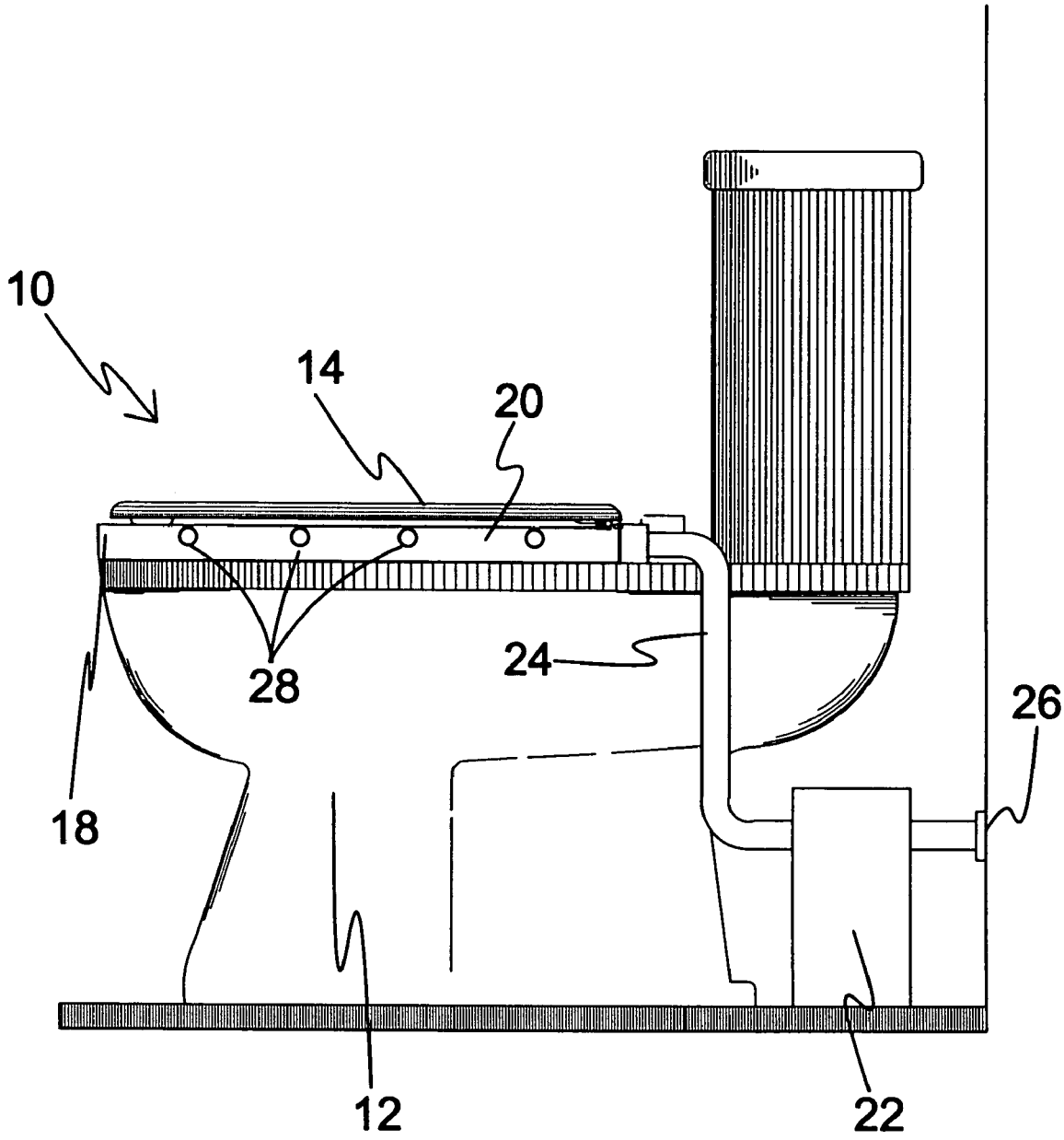
FIG. 5 is a side view of the present invention.

Turning to FIG. 5, shown therein is a side view of the present invention 10. Shown is a side view of the present invention 10 disclosing a fresh air and foul smelling air circulation and extraction device shaped to fit like a gasket 18 between a toilet seat 14 and the top portion of the toilet bowl 12. A plurality of small vents 28 are located at various intervals and allow fresh air from the room to enter into the inner chamber 20 of the device and at the same time, allowing foul air from the toilet bowl to enter into the chamber. The air (fresh and foul) is then sucked from the chamber 20 via a hose 24 by means of a motorized discharge fan 22, which is attached to the hose, sucking the air out through an external discharge vent 26.

Figure 6:
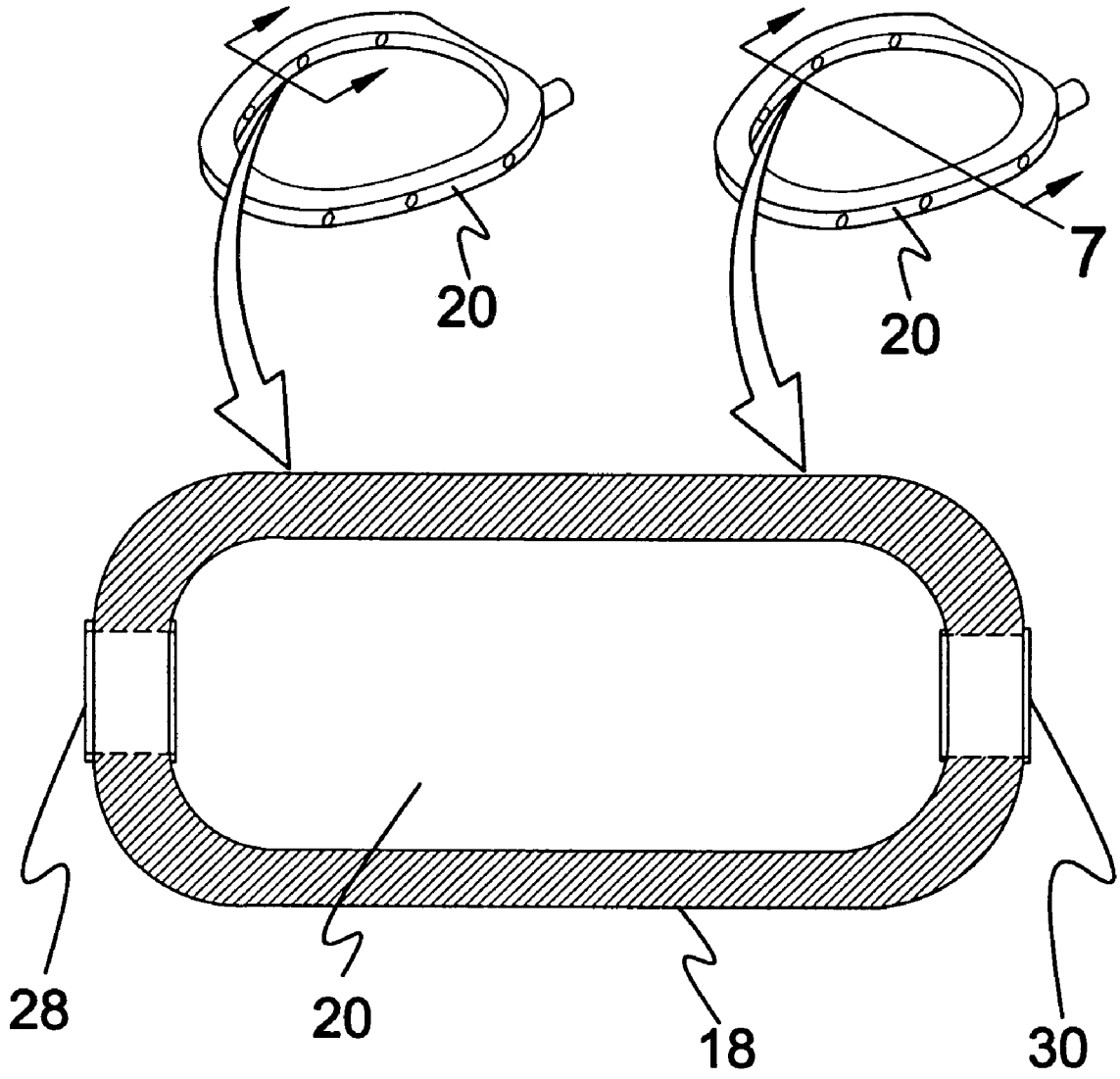
FIG. 6 is a sectional view of the present invention.

Turning to FIG. 6, shown therein is a sectional view of the present invention. Shown is a sectional view of the present invention comprising a fresh air and foul smelling air circulation and extraction device shaped to fit like a gasket 18 between a toilet seat and toilet bowl rim. A plurality of small vents 28 are located at various intervals that allow fresh air from the room to enter into the inner chamber 20 of the device and at the same time allowing foul air from the toilet bowl to enter into the chamber through vents 30. The air (fresh and foul) is then sucked from the chamber 20 via a hose by means of a motor, which is attached to the hose, sucking the air out through an external vent.

Figure 7:
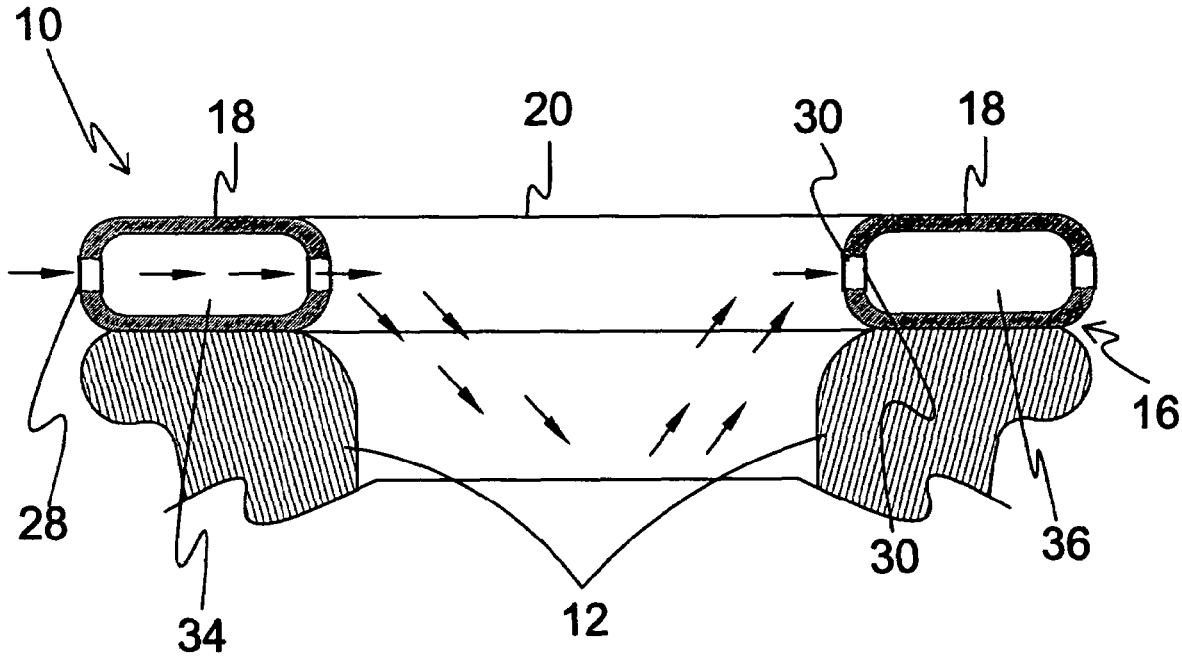
FIG. 7 is a sectional view of the present invention.

Turning to FIG. 7, shown therein is a sectional view of the present invention. Shown is a sectional view of the present invention 10 disclosing a fresh air and foul smelling air circulation and extraction device shaped to fit like a gasket 18 between a toilet seat and the rim 16 of the toilet bowl 12. A plurality of small vents 28 are located at various intervals and allow fresh air at 34 from the room to enter into the inner chamber 20 of the device and at the same time, allowing foul air 36 from the toilet bowl 12 to enter into the chamber through vents 30. The air (fresh and foul) 34, 36 is then sucked from the chamber 20 via a hose by means of a motor, which is attached to the hose, sucking the air out through an external vent.

Figure 8:
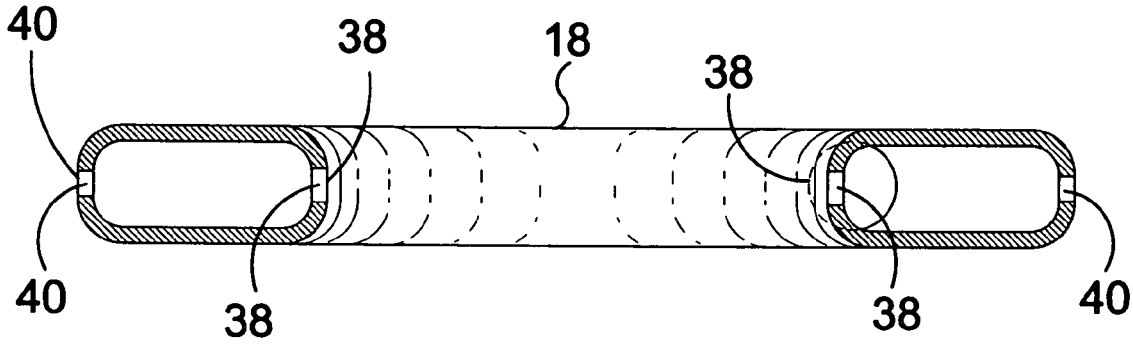
FIG. 8 is a sectional view of an additional element of the present invention.

Turning to FIG. 8, shown therein is a sectional view of an additional element of the present invention. The gasket 18 of the present invention provides for an additional elements in the form of varying the aperture diameters of the exterior ambient air apertures and the toilet bowl interior apertures whereby a larger interior apertures 38 results in a low pressure area/gradient at 38 existing within the bowl interior and a high pressure area/gradient 40 on the exterior side thereby insuring that the majority/percentage of air is drawn from the toilet bowl.

Figure 9:
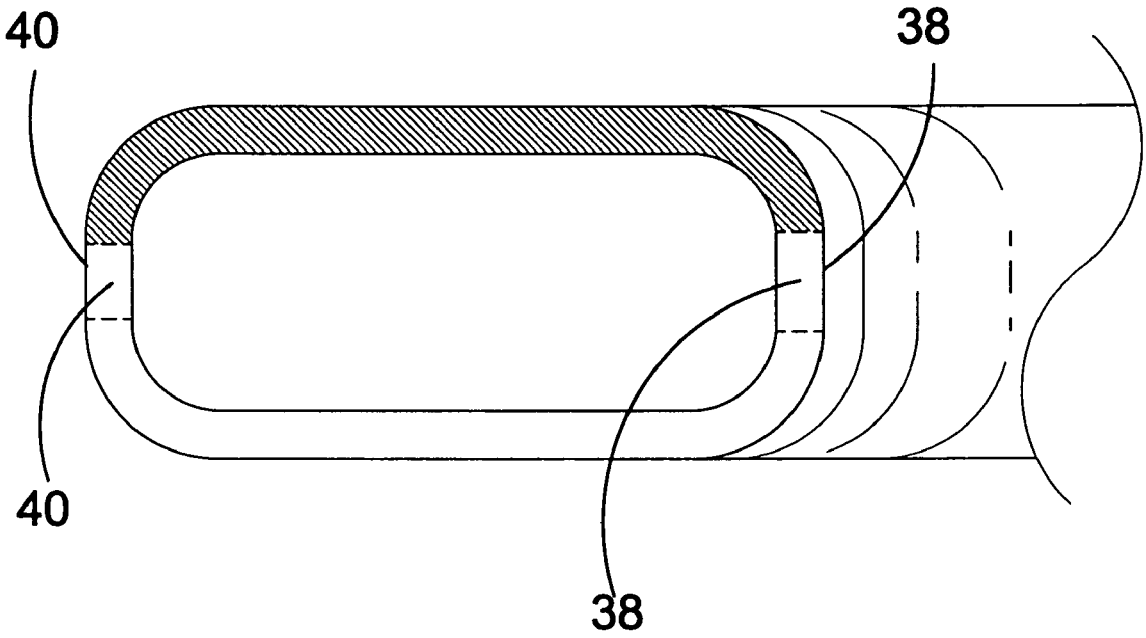
FIG. 9 is a sectional view of an additional element of the present invention.

Turning to FIG. 9, shown therein is a sectional view of an additional element of the present invention. The present invention provides for an additional elements in the form of varying the aperture diameters of the exterior ambient air apertures and the toilet bowl interior apertures whereby a larger interior apertures results in a low pressure area at 38 existing within the bowl interior and a high pressure area at 40 on the exterior side thereby insuring that the majority of air is drawn from the toilet bowl.

Figure 10:
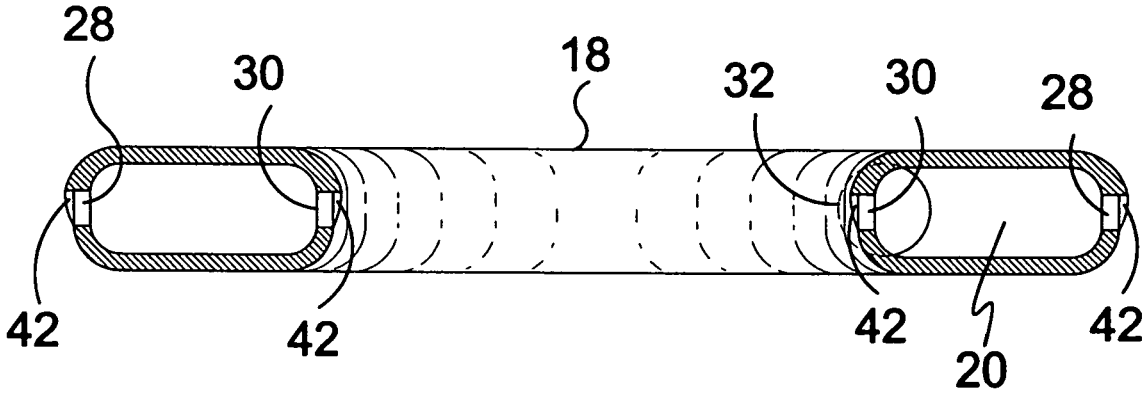
FIG. 10 is a sectional view of another additional element of the present invention.

Turning to FIG. 10, shown therein is a sectional view of another additional element of the present invention. Shown is an additional element of the present invention providing a shield or hood-like element 42 formed over each of the apertures 28, 30 to prevent errant urination from passing into the venting aperture cavity 20, which will allow a longer operative cycle before the oval-like housing gasket 18 is disconnected from the egress conduit 32 and washed.

Figure 11:
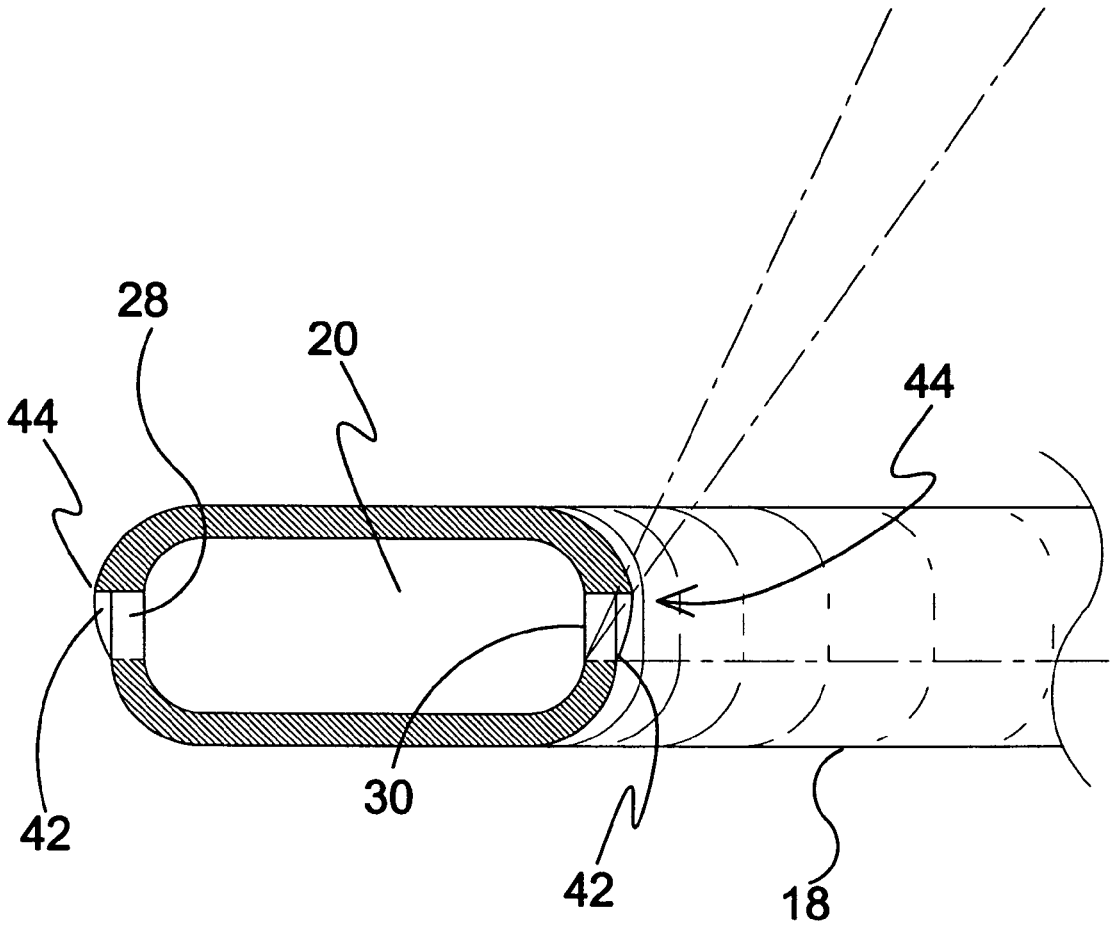
FIG. 11 is a sectional view of another additional element of the present invention.

Turning to FIG. 11, shown therein is a sectional view of another additional element of the present invention. Shown is a sectional view of another additional element of the gasket 18 of the present invention comprising a gradual ridge 44 depending from the aperture sloping out to a point forming a hood 42 over the apertures 28, 30 decreasing the potential of fluid passing into the interior cavity 20 from errant urination.

I claim:

1. An apparatus for venting a toilet bowl, the toilet bowl having an upper rim thereon for supporting a toilet seat, comprising:

a) a gasket being disposed on the upper rim of the toilet bowel, said gasket having front and rear ends, and top, bottom, and first and second opposing side walls thereby forming an inner cavity therein so that said first side wall is disposed toward the exterior of the toilet bowl and said second side wall is disposed toward the interior of the toilet bowl, said gasket being complimentarily shaped as the upper rim of the toilet bowl so as to form a seal between the toilet bowl and the toilet seat;

b) wherein said first side wall has a plurality of exterior apertures therein and said second side wall has a plurality of interior apertures therein, wherein said exterior apertures are spaced apart around said first side wall for receiving fresh air therethrough, wherein said interior apertures are spaced apart around said second side wall for receiving foul air therethrough so that the fresh air and the foul air can enter said cavity;

c) an egress aperture being disposed on said gasket so as to conduct air between said cavity and the exterior of said gasket; and, d) means for exhausting air from said egress aperture whereby air is exhausted from the cavity to the outside ambient air in order to ventilate the toilet bowl.

2. The apparatus of claim 1, further comprising a nipple being disposed on said egress aperture, wherein said nipple extends toward the exterior of said gasket.

3. The apparatus of claim 2, wherein said means for exhausting air from said egress aperture comprises:

a) a conduit having first and second ends, wherein said first end is connected to said nipple;

b) an exhaust fan having an inlet and an outlet, wherein said second end of said conduit connects to said inlet of said exhaust fan; and, c) a discharge vent having an inlet and an outlet, wherein said outlet of said exhaust fan connects to said inlet of said discharge vent and said outlet of said discharge vent conducts air to the outside ambient air so that air from the toilet bowl passes through the cavity, then through the conduit, then through the exhaust fan, and then through the exhaust vent to the outside ambient air so as to ventilate the toilet bowl.

4. The apparatus of claim 3, wherein the diameter of said interior apertures is greater than the diameter of said exterior apertures, wherein a high pressure gradient is formed in said exterior apertures and a low pressure gradient is formed in said interior apertures, wherein a larger percentage of air is drawn from the interior of the toilet bowl than from the exterior of the toilet bowl to ensure that the toilet bowl is ventilated.

5. An apparatus for venting a toilet bowl, the toilet bowl having an upper rim thereon for supporting a toilet seat, comprising:

a) a gasket being disposed on the upper rim of the toilet bowl, said gasket having front and rear ends, and top, bottom, and first and second opposing side walls thereby forming an inner cavity therein so that said first side wall is disposed toward the exterior of the toilet bowl and said second side wall is disposed toward the interior of the toilet bowl, said gasket being complimentarily shaped as the upper rim of the toilet bowl so as to form a seal between the toilet bowl and the toilet seat;

b) wherein said first side wall has a plurality of exterior apertures therein and said second side wall has a plurality of interior apertures therein, wherein said exterior apertures are spaced apart around said first side wall for receiving fresh air therethrough, wherein said interior apertures are spaced apart around said second side wall for receiving foul air therethrough so that the fresh air and the foul air can enter said cavity;

c) an egress aperture being disposed on said gasket so as to conduct air between said cavity and the exterior of said gasket;

d) means for exhausting air from said egress aperture whereby air is exhausted from the cavity to the outside ambient air in order to ventilate the toilet bowl;

e) further comprising a nipple being disposed on said egress aperture, wherein said nipple extends toward the exterior of said gasket, wherein said means for exhausting air from said egress aperture comprises, a conduit having first and second ends, wherein said first end is connected to said nipple; an exhaust fan having an inlet and an outlet, wherein said second end of said conduit connects to said inlet of said exhaust fan; and, a discharge vent having an inlet and an outlet, wherein said outlet of said exhaust fan connects to said inlet of said discharge vent and said outlet of said discharge vent conducts air to the outside ambient air so that air from the toilet bowl passes through the cavity, then through the conduit, then through the exhaust fan, and then through the exhaust vent to the outside ambient air so as to ventilate the toilet bowl; wherein the diameter of said interior apertures is greater than the diameter of said exterior apertures, wherein a high pressure gradient is formed in said exterior apertures and a low pressure gradient is formed in said interior apertures, wherein a larger percentage of air is drawn from the interior of the toilet bowl than from the exterior of the toilet bowl to ensure that the toilet bowl is ventilated; further comprising an exterior shield being disposed over each said exterior aperture, wherein errant urination is prevented from entering said cavity through said exterior apertures.

6. The apparatus of claim 5, further comprising an interior shield being disposed over each said interior aperture, wherein errant urination is prevented from entering said cavity through said interior apertures.

7. The apparatus of claim 5, wherein said exterior shield depends from said top portion of said gasket.

8. The apparatus of claim 7, wherein said top portion of said gasket forms a first ridge extending outwardly beyond said bottom portion of said gasket, wherein said exterior shield depends from said first ridge.

9. The apparatus of claim 6, wherein said interior shield depends from said top portion of said gasket.

10. The apparatus of claim 9, wherein said top portion of said gasket forms a second ridge extending inwardly beyond said bottom portion of said gasket, wherein said exterior shield depends from said second ridge.

11. The apparatus of claim 10, wherein said egress aperture is disposed on said rear of said gasket.

* * * * *